US009510627B2

(12) United States Patent
Trimble et al.

(10) Patent No.: US 9,510,627 B2
(45) Date of Patent: Dec. 6, 2016

(54) MEDICAL APRON APPARATUS

(71) Applicants: Carole Trimble, Mechanicsburg, OH (US); Dawn Peterson, Ashville, OH (US)

(72) Inventors: Carole Trimble, Mechanicsburg, OH (US); Dawn Peterson, Ashville, OH (US)

( * ) Notice: Subject to any disclaimer, the term of this patent is extended or adjusted under 35 U.S.C. 154(b) by 0 days.

(21) Appl. No.: 14/660,691

(22) Filed: Mar. 17, 2015

(65) Prior Publication Data

US 2015/0257463 A1 Sep. 17, 2015

Related U.S. Application Data

(60) Provisional application No. 61/953,961, filed on Mar. 17, 2014.

(51) Int. Cl.

| | |
|---|---|
| ***A41D 13/04*** | (2006.01) |
| ***A41D 13/12*** | (2006.01) |
| ***A41D 27/20*** | (2006.01) |

(52) U.S. Cl.

CPC ..... *A41D 13/1236* (2013.01); *A41D 13/04* (2013.01); *A41D 13/1245* (2013.01); *A41D 27/20* (2013.01)

(58) Field of Classification Search

CPC A41D 13/04; A41D 13/0015; A41D 13/1236; A41D 27/20; A41B 13/10

USPC ..... 2/48, 49.1, 69, 114, 247, 250, 254

See application file for complete search history.

(56) References Cited

U.S. PATENT DOCUMENTS

| | | | | |
|---|---|---|---|---|
| 4,495,662 | A | 1/1985 | Miller | |
| 4,666,432 | A * | 5/1987 | McNeish | A61M 25/02 128/DIG. 26 |
| D461,945 | S | 8/2002 | Byrd | |
| 6,460,187 | B1 | 10/2002 | Siegel | |
| 6,477,710 | B1 * | 11/2002 | Ojoyeyi | A41D 13/1236 2/114 |
| 6,574,800 | B1 | 6/2003 | Leger et al. | |
| 6,681,404 | B1 * | 1/2004 | Adlard | A41D 13/1245 2/94 |
| D544,095 | S | 6/2007 | McLaughlin | |
| 7,364,491 | B2 * | 4/2008 | Updyke | A41C 3/0035 2/247 |
| 7,942,856 | B2 | 5/2011 | Lentini | |
| D657,939 | S | 4/2012 | Mathews | |
| 8,156,878 | B2 * | 4/2012 | Lazar | A41D 13/1281 112/475.09 |
| 2013/0245584 | A1 | 9/2013 | Krasikoff et al. | |

* cited by examiner

*Primary Examiner* — Tejash Patel

(74) *Attorney, Agent, or Firm* — Benesch Friedlander Coplan & Aronoff, LLP; Thomas Y. Kendrick

(57) ABSTRACT

A medical apron apparatus for use by a medical patient is provided, the medical apron apparatus comprising: an apron; and at least one pocket on a surface of the apron, wherein the at least one pocket is sized and shaped to carry one or more patient medical devices. In example embodiments, the medical apron apparatus is used to manage and store patient medical devices, prevent damage to a patient's clothing, prevent an operation or surgery location on a patient, or the medical device itself.

8 Claims, 6 Drawing Sheets

MEDICAL APRON APPARATUS

CROSS-REFERENCE TO RELATED APPLICATIONS

This application claims priority from U.S. Provisional Patent Application No. 61/953,961, filed on Mar. 17, 2014, which is incorporated by reference herein in its entirety.

BACKGROUND

Many medical procedures require the use of medical devices such as drainage tubes and collection vessels for the treatment and healing process of patients undergoing and/or recuperating from such medical procedures. Loose drainage tubes present the risk of becoming caught and tangled. Caught and tangled tubes may pull at the attachment site to a patient's body causing physical pain to a patient. If pulled with enough force, drainage tubes that become caught and tangled on other objects may cause the tubes to become detached and could lead to infection. Aiding patients in juggling tubes and containment vessels in the hospital and other medical institutions results in lost productivity for nursing and therapy staff.

Traditional methods of securing drainage tubes to a patient's clothing with pins may present a puncture risk to the drainage tubes, and again may lead to risk of infection and leakage. Pinning medical devices to a patient's clothing may make the clothing uncomfortable, tear the clothing, and provide an untidy appearance. Drainage tubing and collection vessels pinned to the outside of a patient's clothing may be unsightly and cause a patient to be self-conscious in public. What is needed is an apparatus for securing, managing, and containing patient medical devices that meets requirements for institutional use and care, as well as home care for patients.

SUMMARY

In one embodiment, a medical apron apparatus for use by a medical patient is provided, the apparatus comprising: an apron; a pocket on a surface of the apron; a proximal surface proximal to the medical patient, and a distal surface; and an aperture through which a medical device may pass and be stored in the pocket on the surface of the apron.

In another embodiment, a medical apron apparatus for use by a medical patient is provided, the medical apron apparatus comprising: an apron; an aperture on a surface of the apron, the one or more apertures operable to allow one or more medical devices or portions of the one or more medical devices to pass through the apron; and a pocket on a surface of the apron, the pocket comprising an inner volume, the inner volume formed as an area between the surface of the apron and portions of pocket material not secured to the surface of the apron, the pocket further comprising a pocket opening defined as peripheral portions of the pocket material not secured to the surface of the apron and through which the inner volume may be accessed.

In another embodiment, a medical apron apparatus for use by a medical patient is provided, the medical apron apparatus for use by a medical patient, comprising: (1) an apron, the apron further comprising: a bib portion covering a user's torso region above a waist region, wherein the bib portion comprises at least one of: a neck strap, and one or more shoulder straps; and a waist portion covering the user's torso and limbs below the waist region, the waist portion selectively detachable from the bib portion, wherein an attachment hardware is provided in an area between the bib portion and the waist portion for securing the apron about the waist region of a user, and wherein the apron comprises a liquid-resistant, quick drying, and washable material; (2) an aperture on a surface of the apron, the aperture operable to allow one or more medical devices or portions of the one or more medical devices to pass through the apron; and (3) a pocket on the surface of the apron, the pocket comprising an inner volume, the inner volume formed as an area between the surface of the apron and portions of pocket material not secured to the surface of the apron, the pocket further comprising a pocket opening defined as peripheral portions of the pocket material not secured to the surface of the apron and through which the inner volume may be accessed, wherein a flap covering the pocket opening is selectively securable to at least the surface of the apron to selectively provide access to the inner volume.

BRIEF DESCRIPTION OF THE DRAWINGS

The accompanying figures, which are incorporated in and constitute a part of the specification, illustrate various example systems and methods, and are used merely to illustrate various example embodiments.

DETAILED DESCRIPTION

Figure 1:
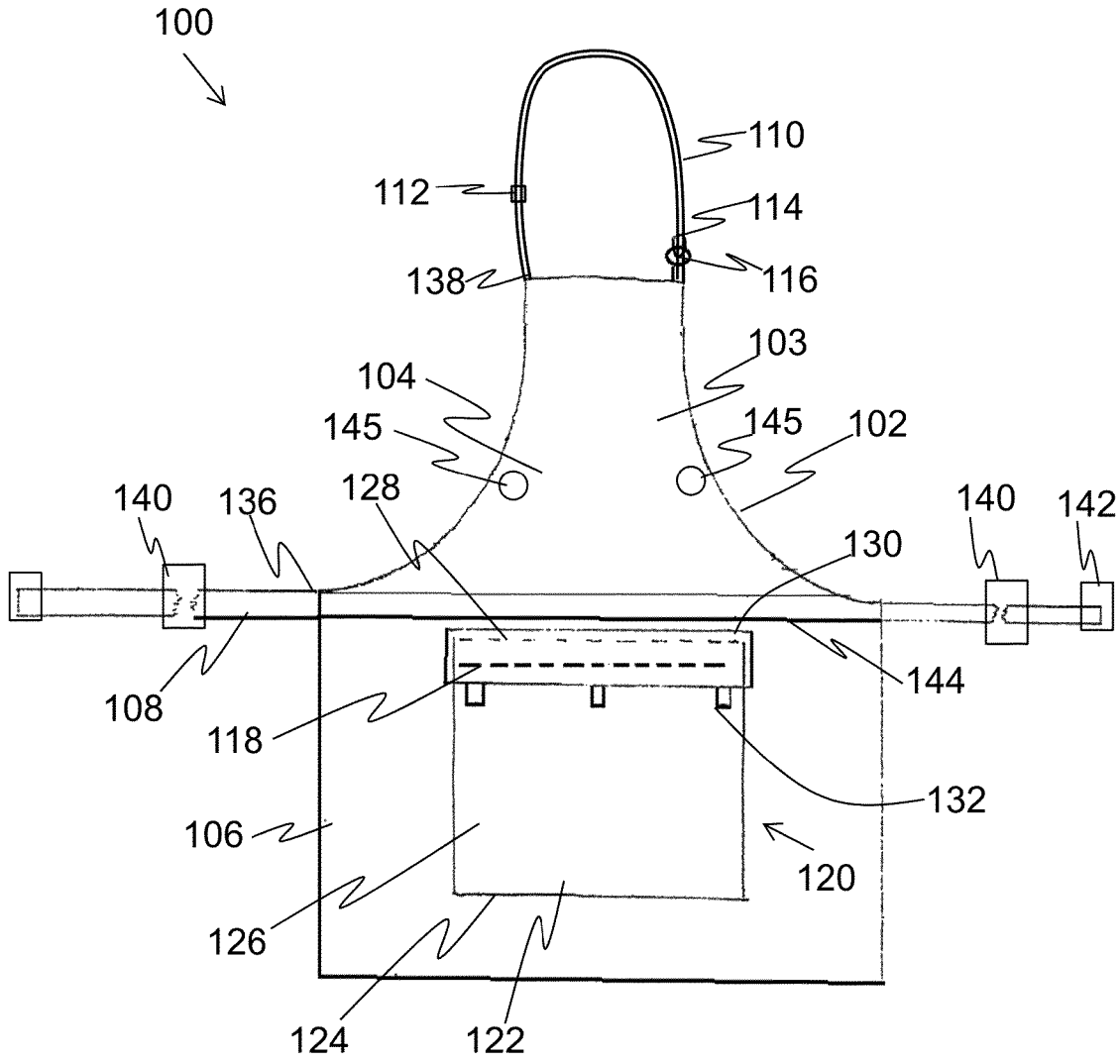
FIG. 1 illustrates a front elevation view of an example medical apron apparatus.

FIG. 1 illustrates a front elevation view of a medical apron apparatus 100. Medical apron apparatus 100 may be worn by a patient undergoing a medical treatment and post-medical treatment for use in managing medical devices such as drainage tubes, collection vessels, ostomy bags, wires, data recorders, and the like. Medical apron apparatus 100 may prevent medical devices from becoming entangled by a surrounding environment and may contribute to a patient undergoing a medical treatment and post-medical treatment being more ambulatory. In one embodiment, medical apron apparatus 100 is designed to be worn over a patient's everyday clothing. In another embodiment, medical apron apparatus is designed to be worn over medical clothing designed for patients undergoing medical treatment and post-treatment recovery.

FIG. 1 illustrates a front elevation of medical apron apparatus 100. Medical apron apparatus 100 may comprise an apron 102 and a pocket 120.

Apron 102 having a surface 103 may comprise multiple parts such as a bib, or superior portion 104, a waist, or inferior portion 106, one or more lower trunk straps 108, a neck strap 110 for securing apron 102 about the neck or shoulders of a patient, attachment ring 116, one or more apertures 118, and one or more pockets 120. Apron 102 need not be limited for use on a user's front side, but may also be adapted for use on a user's back or dorsal side. As used herein surface 103 may refer to both a proximal surface of apron 102 closest to, or against a patient's clothing or body, and a distal surface of apron 102 farthest from, and not in contact with a patient's clothing or body.

In one embodiment, apron 102 is of a liquid-resistant, quick-drying material, capable of sustained washing in institutional laundry facilities that is easily constructed into a garment such as: treated cotton, polyester, nylon, neoprene, spandex, and the like. In one embodiment, apron 102 is of a material that is comfortable to a wearer for prolonged wear. In another embodiment, apron 102 is of a material robust enough to support one or more medical devices. Apron 102 may be of a material that is easily washable, a material that may be easily laundered, and a material strong enough to sustain frequent washing in institutional laundries. In one embodiment, surface 103 of apron 102 is treated with a chemical coating or treatment such as waxing, waterproofing, and the like to provide a liquid resistance to apron 102.

Bib portion, or superior portion 104 may comprise one or more lower trunk straps 108, and neck strap 110 for securing apron 102 about the neck or shoulders of a patient, attachment ring 116, one or more apertures 118, and one or more pockets 120. Bib portion 104 may be designed as a "one size fits all" design or bib portion 104 may be constructed in different sizes to accommodate a variety of patients.

Bib portion 104 may comprise one or more lower trunk straps 108. Lower trunk strap 108 may comprise one or more pieces of material designed to be secured around a lower torso portion of a patient such as an abdominal area or lumbar area. In one embodiment, lower trunk strap 108 is secured around the waist of a user.

As a result of a medical procedure, such as a surgery, it may not be ideal for a patient to secure apron 102 about the waist using lower trunk strap 108 as doing so may add pressure and cause pain to a surgical site during recovery. In one embodiment, the location of lower trunk strap 108 may be readily adjusted on bib, or superior portion 104, and waist, or inferior portion 106 of apron 102 to provide a custom attachment point of apron 102 on each patient.

Lower trunk strap 108 may be a single piece of material such as a strap or drawstring integrated into the construction of apron 102. In another embodiment, lower trunk strap 108 may be a belt which interfaces with apron 102 with one or more external garment modifications such as a belt loop.

One or more lower trunk straps 108 may be sewn to apron 102 at lower strap attachment point 136.

In one embodiment, one or more lower trunk straps 108 may attach to lower strap attachment point 136 on apron 102 such that one or more lower trunk straps 108 may be removed from apron 102. Attachment hardware at lower strap attachment point 136 may be a buckle through which lower trunk strap 108 may be woven. In one embodiment, attachment hardware at lower strap attachment point 136 is a quick release buckle with a male/female portion attached at lower strap attachment point 136 and a corresponding male/female portion attached to lower trunk strap 108 such that inserting the male portion into the female portion provides a secure attachment. In another embodiment, lower trunk strap 108 has a quick connect hardware such as a carabiner or clasp thereon to interface with a loop or ring at lower strap attachment point 136. Lower trunk strap 108 may have an attachment hardware such as a hook and loop fastener to secure trunk lower strap 108 to a corresponding hook and loop fastener at lower strap attachment point 136.

Lower trunk strap 108 may be elasticized or elastic such that lower trunk strap 108 may be flexible and stretch.

One or more lower trunk straps 108 may be secured around a portion of a patient and tied to secure a lower portion of apron 102 to a patient. In one embodiment, one or more lower trunk straps 108 have a lower strap-to-lower strap attachment interface 142 such as a clasp/carabiner and ring, hook and loop, hook and eye, buttons, snaps, buckles, magnets, and the like on the ends thereof for securing lower trunk straps 108 about the body of a patient. Lower trunk straps 108 may have a lower strap adjustment hardware 140 such as a buckle, retractable reel, or other common adjustment hardware thereon for adjusting the length of lower trunk straps 108.

Figure 2:
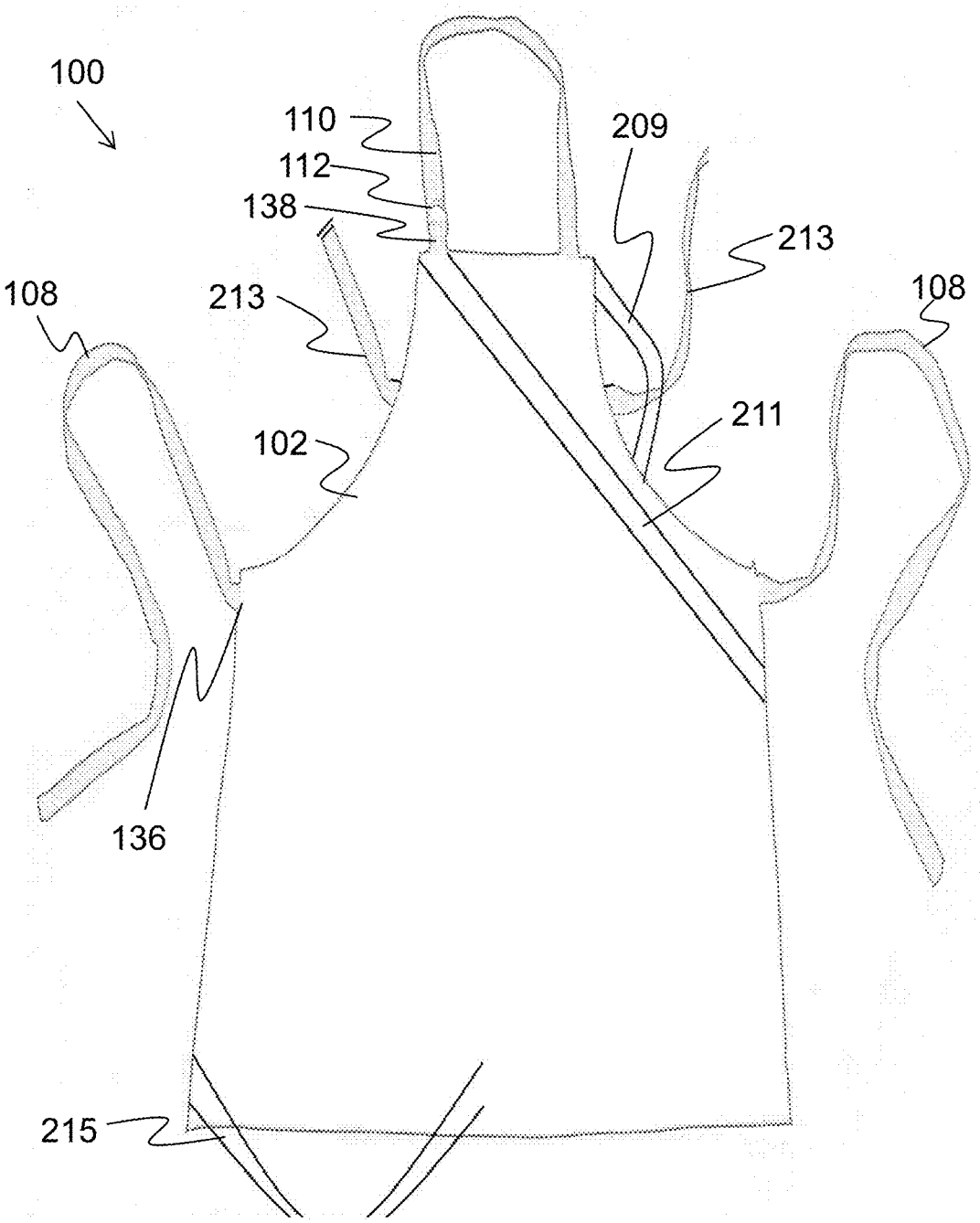
FIG. 2 illustrates a rear elevation view of an example medical apron apparatus.

Referring now to FIG. 2, other example attachments for securing medical apron apparatus 100 to a patient are illustrated. In addition to neck strap 110, and lower trunk strap 108, as described above, medical apron apparatus 100 may also include one or more of shoulder strap 209, shoulder sash 211, upper trunk strap 213, and leg strap 215, all of which may be referred to generally as an "attachment," where such attachment may be used to secure medical apron apparatus 100 to a patient.

While neck strap 110 may be used to secure apron 102 about a neck of a patient, shoulder straps 209 and shoulder sash 211 may be used to secure apron 102 about the shoulder(s) of a patient. In one embodiment, a patient may choose to use each of neck straps 110, shoulder strap 209, and shoulder sash 211. Neck strap 110, shoulder strap 209, and shoulder sash 211 are selectively removable from apron 102 so as to provide a custom fit for each patient who may prefer wearing apron 102 with either neck strap 110, shoulder strap 209, shoulder sash 211, or any combination thereof. In another embodiment, upper straps 110 are shoulder straps similar to a bib-and-brace attachment of an overall garment. In one embodiment where shoulder straps 209 and shoulder sash 211 are used, straps similar to an overall garment, with one more shoulder sashes 211 attaching to shoulder straps 209, or like hybrid, may be used with shoulder sash 209 extending diagonally across as user's torso and connecting to an area on apron 102 opposite a user's shoulder (relative to a median sagittal plain), such as lower strap attachment point 136. In this embodiment, shoulder straps and back straps are the same straps and crisscross at an adjustment point (not shown), like a back strap of an overall. In another embodiment, shoulder strap 209 connects bib portion 104 to a back bib portion (not shown) similar in style to a pinafore. Neck strap 110, shoulder strap 209, and shoulder sash 211 may be designed so that apron 102 may be easily secured by a patient with limited mobility (e.g., arm movement) after a medical procedure, or neck strap 110, shoulder strap 209, and shoulder sash 211 may be designed so that a caregiver may easily attach apron 102 to a patient.

In one embodiment, neck strap 110 is used as the primary load bearing point of apron 102 and is used alone and in combination with other attachments 108, 209, 211, 213, and 215 to secure apron 102 to patient. Neck strap 110 may be fixedly attached to apron 102 at neck strap attachment portion 138. Neck strap attachment portion 138 may include a permanent fixture of neck strap 110 to apron 102 through sewing, stitching, riveting, adhesives, and the like. In one embodiment, neck strap attachment portion 138 may include attachment hardware 116 for selectively removing all or portion of neck strap 110 from apron 102. In one embodiment, attachment hardware 116 is an O-ring, D-ring, or similar attachment hardware that interfaces with one or more strap attachment hardware 114 on neck strap 110 for selectively securing neck strap 110 to apron 102. In one embodiment, strap attachment hardware 114 is a carabiner/clasp type hardware to provide a quick connection to attachment hardware 116. Neck strap 110, like lower trunk straps 108, may include similar attachment embodiments as described above to attach lower straps 108 to lower strap attachment point 136 for attaching neck strap 110 to neck strap attachment portion 138. In one embodiment, neck strap 110 includes adjustment hardware 112 thereon for adjusting a length of neck strap 110. Adjustment hardware 112 may be a buckle through which portions of neck strap 110 are woven to shorten and slacken a length of neck strap 110. In one embodiment, adjustment hardware 112 is a retractable reel with a clutch, which when pulled, either provides slack or retracts slack from neck strap 110. Neck strap 110 may share similar characteristics of lower trunk straps 108. Neck strap 110 may be a flat, rugged strap of a material such as nylon, canvas, Cordura®, and the like. Neck strap 110 may be a braided drawstring of an elasticized material. Neck strap 110 may be customized based on comfort and preference of a patient and is thus selectively removable from apron 102 to provide for patient customization. Upper trunk strap 213 may be used to secure apron 102 about a thoracic (chest) or dorsal (upper back) area on a patient, while leg strap 215 may be used to secure apron 102 about a leg of a user. All attachments 108, 110, 209, 211, 213, and 215 may share similar characteristics and functionalities as is described above for lower trunk strap 108, and neck strap 110.

With further reference to FIG. 1, apron 102 may comprise a waist, or inferior portion 106. Waist portion 106 may cover portions of a patient's lower torso and all or part of a patient's lower limbs. Waist portion 106 may be selectively removable from bib, or superior portion 104 at a bib portion attachment point 144.

In one embodiment, waist portion 106 includes modular functionality that allows for one or more different waist portions 106 to attach to one or more different bib portions 104. In this embodiment, different waist portions 106 are combined with different bib portions 104 to create a custom apron based on a patient's needs. For example, one patient may prefer use of bib portion 104 with shoulder straps as upper straps 110 combined with a short waist portion 106 which does not extend past a patient's knees. In another example, another patient may prefer use of bib portion 104 with a neck strap as an upper strap 110 with a long waist portion 106 which extends past a patient's knees. A modular arrangement may provide varying degrees of customization for a patient. Bib portion attachment point 144 may include an attachment hardware common in the art such as a zipper, hook and loop fasteners, one or more buttons and corresponding buttonholes, one or more snaps, and the like. Waist portion 106 may include one or more lower trunk straps 108 such that waist portion 106 may be worn alone without bib portion 104. Lower trunk straps 108 secured to waist portion 106 may interact with portions of a patient's clothing (e.g. belt loops) to provide more secure fit of waist portion 106 when waist portion 106 is worn alone without bib portion 104.

In one embodiment, both waist portions 106 and bib portion 104 include one or more lower trunk straps 108 such that bib portion 104 and waist portion 106 may be worn alone or in combination with one another. Inferior portion 106 may fold about bib portion attachment point 144, and inferior portion 106 may be secured to superior portion 104 via a superior portion surface attachment hardware 145 so as to give an appearance that only bib portion 104 is being worn; or waist portion 106 may be stowed without detaching waist portion 106 from bib portion 104 so as to provide added convenience when using the bathroom, or some similar activity of daily living. Superior portion surface attachment hardware 145 may be a fastener hardware such as a hook and loop fastener operable to attach to a corresponding hook and loop fastener on inferior portion 106, a snap operable to connect to a corresponding snap on inferior portion 106, or a strap and buckle that will store inferior portion 106 when rolled toward superior portion 104, and like hardware.

Both bib portion 104 and waist portion 106 may include one or more apertures 118 in surface 103 of apron 102 such that one or more medical devices or portions of one or more medical devices may be passed through apertures 118. Apertures 118 may allow medical devices such as drainage tubes, collection vessels, ostomy bag connections, wiring, and the like, to be passed from a surface of apron 102 adjacent a patient's body through apron 102 to an external surface 103 of apron 102. In one embodiment, apertures 118 include hardware (not shown) for varying a size of apertures 118. In this embodiment, apertures 118 use at least one of a zipper, a hook and loop fastener, a button and buttonhole, a snap, and the like to vary a size of apertures 118 to allow for larger medical devices to be passed through apron 102 via apertures 118, while also providing a secure attachment for medical devices already passed through apertures 118 (e.g., one or more drainage tubes may be separated by buttons or hook and loop fasteners to prevent one or more drainage tubes from tangling). Apertures 118 may be designed based on a patient's medical procedure and used with modular functionality of bib portion 104 and waist portion 106 to create a customized apron 102. For example, a patient recovering from a mastectomy may have apertures 118 on bib portion 104 corresponding to drainage tubes sites associated therewith, while a patient recovering from a gallbladder procedure may have apertures 118 on apron 102 in an area close to that procedure site. Apertures 118 may be reinforced by stitching or another garment treatment to provide for rugged use.

Bib portion 104 and waist portion 106 of apron 102 may comprise one or more pockets 120. One or more pockets 120 may cover apertures 118 such that medical devices passed through apertures 118 may be secured in an inner volume 126 of pockets 120. In one embodiment, pockets 120 are located on an external surface 103 of apron 102—that is, an external surface 103 not adjacent to a patient's body. In this embodiment, pockets 120 on external surface 103 of apron 102 allow both patient and medical personnel easy access to inner volume 126 of pockets 120 for medical care and treatment (e.g., monitoring and emptying of collection vessels).

Pockets 120 may be comprised of a material sheet 122 having sides 124 secured to portions of apron 102. In one embodiment, two or more sides 124 of material sheet 122 are secured to apron 102 to form pockets 120. In one embodiment, inner volume 126 is defined by an area bounded by sides 124 of material sheet 122 connected to apron 102 and a volume between material sheet 122 and apron 102. Material sheet 122 may have one side 128 not secured to apron 102 to define a pocket opening 128. Material sheet 122 may be of a same material as apron 102. Material sheet 122 may include a waterproof material configured to at least partially contain liquids that may leak within inner volume 126.

In one embodiment, pocket opening 128 may include a flap 130, a portion of flap 130 secured to apron 102 and designed to cover pocket opening 128. Another portion of flap 130 may secure to portions of apron 102 or pocket 120 via a flap securing hardware 132. In one embodiment, flap securing hardware 132 may be a hook and loop hardware on a surface 103 of apron 102 or pocket 120 that interfaces with a corresponding hook and loop securing hardware 132 on a portion of flap 130. Flap securing hardware 132 may also be a similar flap securing hardware 132 such as a button and button hole, snaps, a zipper, and the like, so as to provide easy access to inner volume 126 of pocket 120.

One or more pockets 120 may be located on both bib portion 102 and waist portion 106 of apron 102 based on patient need so as to provide support and organization of medical devices passed through apertures 118 and stored in inner volume 126 of one or more pockets 120. In one embodiment, pocket opening 128 may not include a flap 130, and pocket opening 128 may be secured by a hardware such as a zipper, a button and buttonhole, a snap, a hook and loop fastener, and the like.

In another embodiment, sides 124 of pocket 120 may be secured to apron 102 by a selectively engageable hardware or adhesive such as a hook and loop fastener to selectively remove, and thus customize placement of pockets 120 on apron 102.

Figure 3:
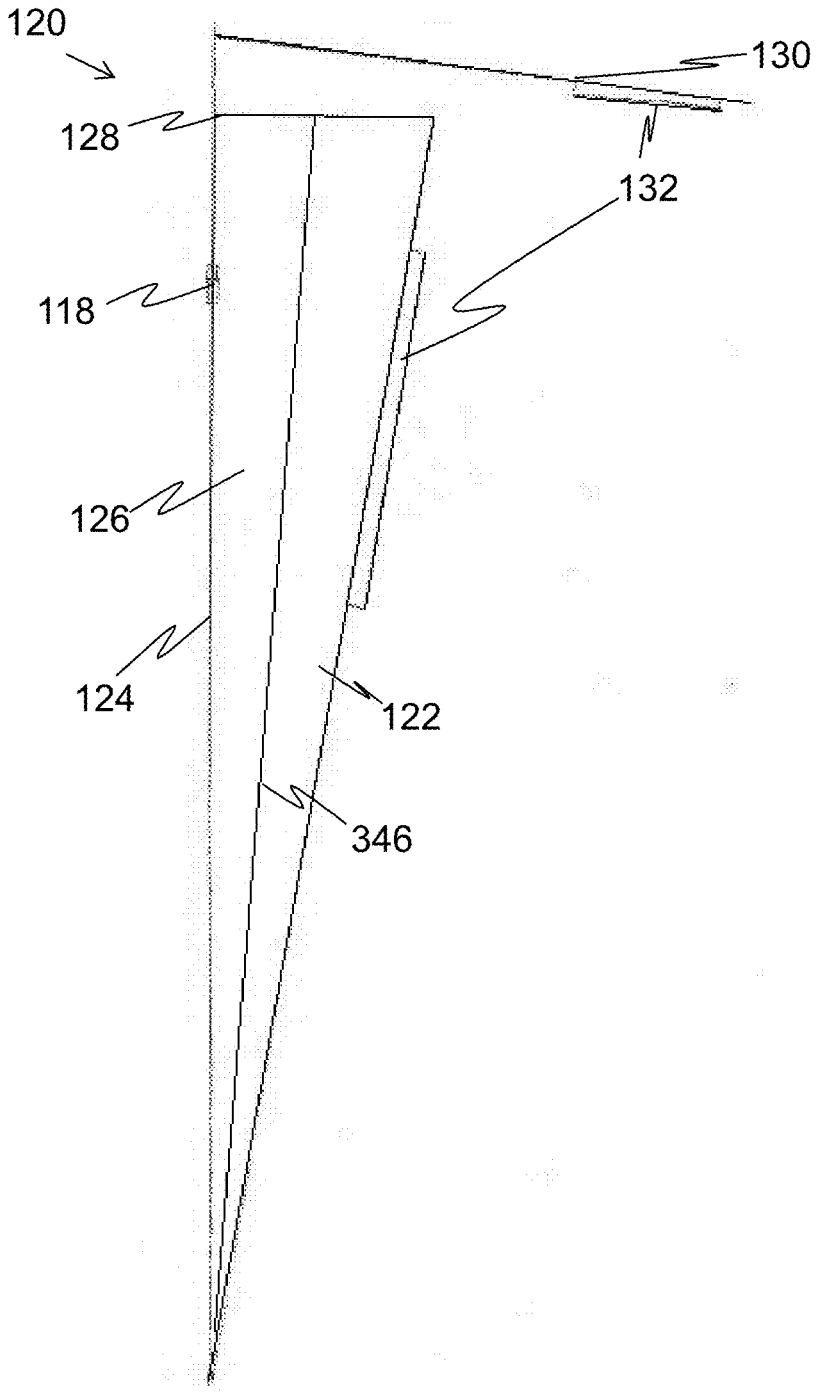
FIG. 3 illustrates a side elevation view of an example pocket on a medical apron apparatus.

Referring to FIG. 3, a side view of pocket 120 is illustrated. Pocket 120 may comprise folded, pleated, gusset 346 to provide for expansion of pocket 120, and thus enlarge inner volume 126 of pocket 120 to accommodate medical devices of varying sizes. In one embodiment, gusset 346 may be selectively actuated through a hardware such as a zipper, a hook and loop fastener, a button and buttonhole, snaps, and the like to selectively expand inner volume 126 of pocket 120. In another embodiment, gusset 346 automatically expands based on a size of medical device placed within inner volume 126 of pocket 120.

Figure 4:
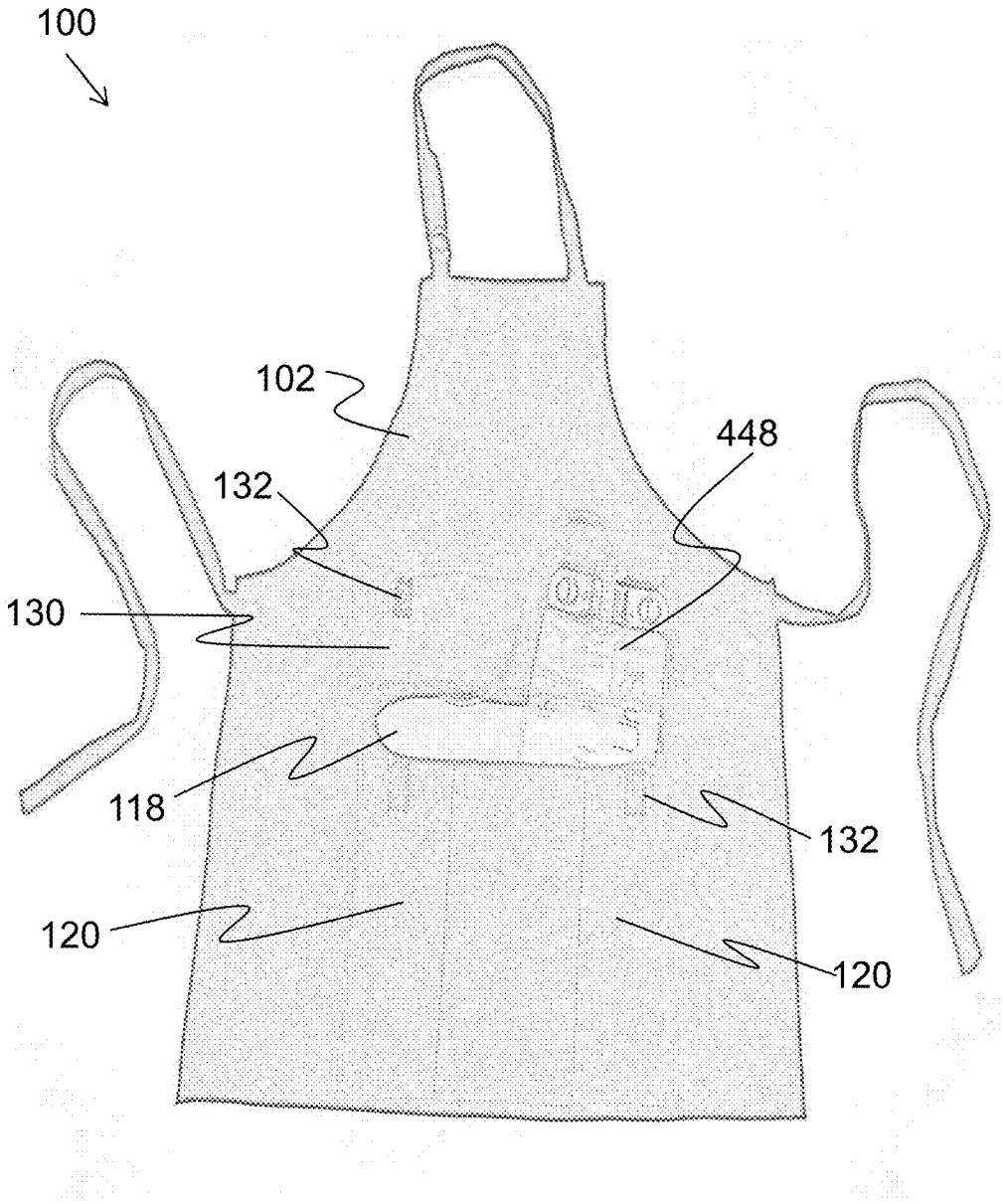
FIG. 4 illustrates a front elevation view of an example medical apron apparatus with various example attachments.
Figure 5:
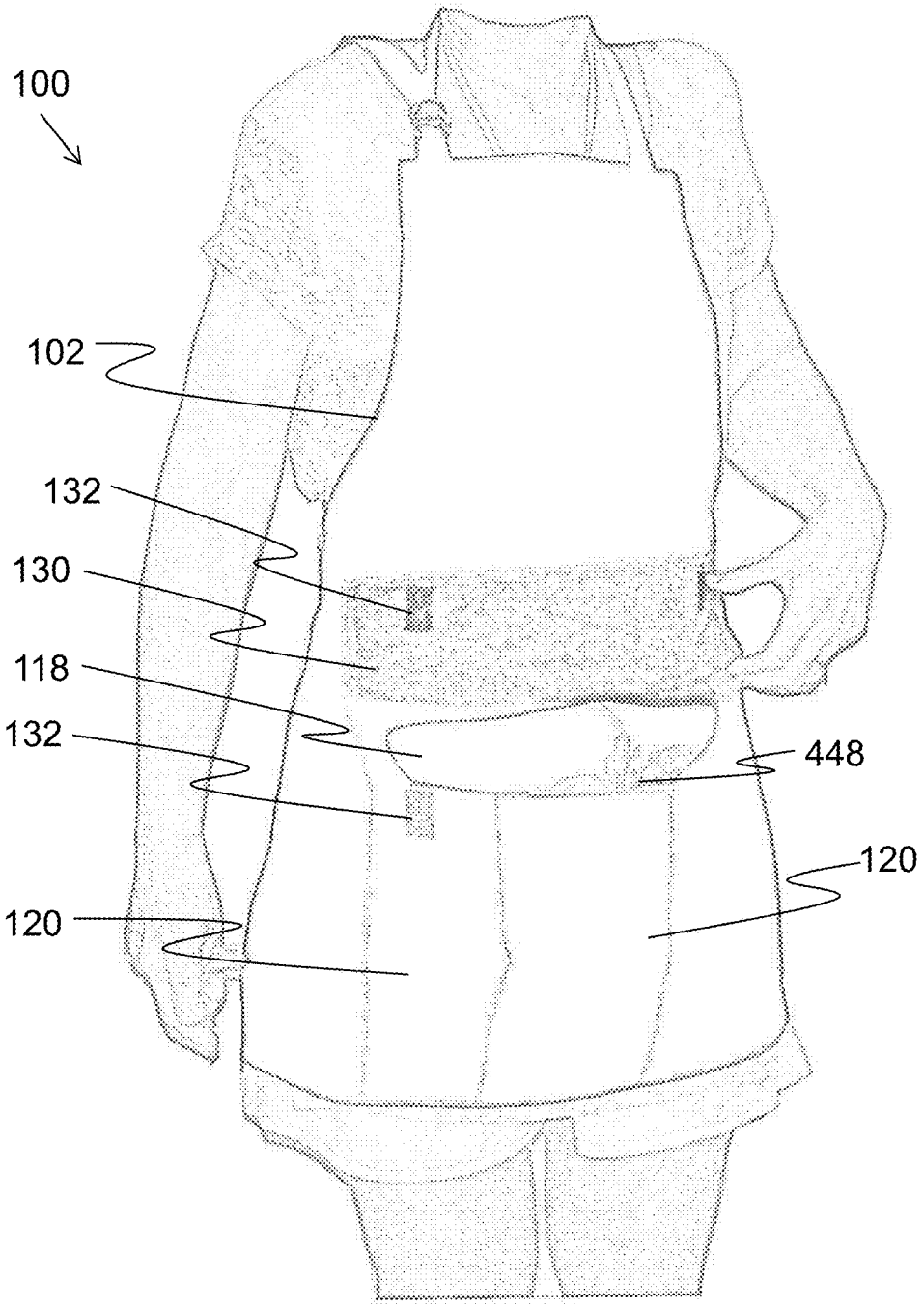
FIG. 5 illustrates a perspective view of an example medical apron apparatus as worn by a medical patient.

FIGS. 4 and 5 illustrate views of example medical apron apparatus 100 as used with a medical device 448. Medical device 448 may include, but is not limited to such medical devices as: a drainage bag, a specimen container, a collection container, a collection bag, an ostomy bag, a medical tubing, an IV bag, a catheter, a battery, an electronic medical monitoring device, a suction device, medical supplies, a gas canister, and a pump. Medical device 448 may be accessed through aperture 118 and medical device 448 may be stored in pocket 120. Flap 130 may be operable to secure in both of an open position and closed position to surface 103 of apron 102 by flap securing hardware 132.

Figure 6:
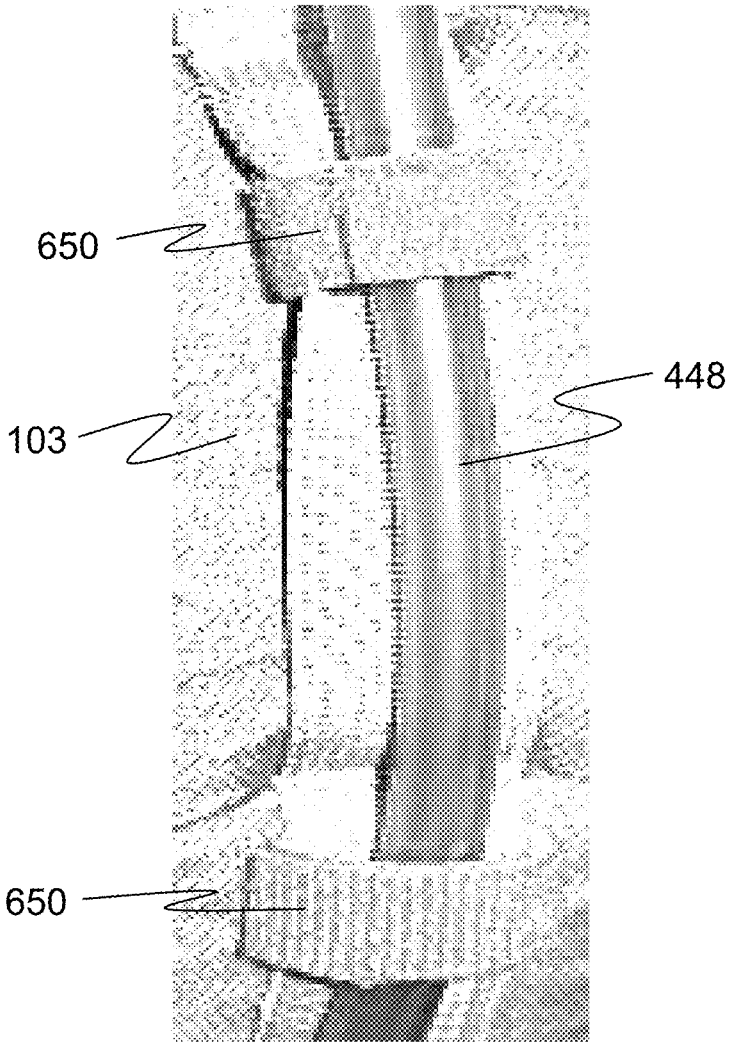
FIG. 6 illustrates an example medical device management hardware on an example medical apron apparatus.

With reference to FIG. 6, example medical device management hardware 650 is illustrated. Surface 103 and pocket 120 of apron 102 may comprise one or more medical device management hardware 650 for securely managing a medical device 448 such as a medical tube.

In one embodiment, medical device management hardware 650 is comprises a strap securedly attached to surface 103 of apron 102 with a hook and loop fastener (e.g. Velcro®) on one side of a strap, and a complimentary hook and loop fastener on another side of a strap, such that medical device management hardware 650 wraps around medical device 448 and secures to itself (i.e. one side of medical device management hardware 650 strap secures to another side of medical device management hardware strap 650) to secure medical device 448 in place, prevent snags of medical device 448, and prevent kinking of medical device 448 so as to keep medical device 448 in proper working order.

In another embodiment, medical device management hardware 650 is a strap secured within an inner volume of pocket 120 to secure medical device 448 such as a drainage bag in an upright position to optimize function of medical device 448, prevent spilling or leaking of medical device 448, and the like. Medical device management hardware 650 may include straps with proper attachment hardware such as hoop and loop fasteners, buckles, rings, clasps, for attaching a securing medical device 448 to apron 102, as well as proper adjustment hardware such as buckles and rings for adjusting a length of medical device management hardware 650 to accommodate and secure medical devices 448 of different sizes. In one embodiment, medical device management hardware may be an elastic, mesh webbing/net, through and/or under which, a medical device 448 may be secured.

Unless specifically stated to the contrary, the numerical parameters set forth in the specification, including the attached claims, are approximations that may vary depending on the desired properties sought to be obtained according to the exemplary embodiments. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Furthermore, while the systems, methods, and apparatuses have been illustrated by describing example embodiments, and while the example embodiments have been described and illustrated in considerable detail, it is not the intention of the applicants to restrict, or in any way limit, the scope of the appended claims to such detail. It is, of course, not possible to describe every conceivable combination of components or methodologies for purposes of describing the systems, methods, and apparatuses. With the benefit of this application, additional advantages and modifications will readily appear to those skilled in the art. Therefore, the invention, in its broader aspects, is not limited to the specific details and illustrative example and exemplary embodiments shown and described. Accordingly, departures may be made from such details without departing from the spirit or scope of the general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

As used in the specification and the claims, the singular forms "a," "an," and "the" include the plural. To the extent that the term "includes" or "including" is employed in the detailed description or the claims, it is intended to be inclusive in a manner co-extensive with the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Also, to the extent that the terms "in" or "into" are used in the specification or the claims, it is intended to additionally mean "on" or "onto." To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. Finally, where the term "about" is used in conjunction with a number, it is intended to include ±10% of the number. In other words, "about 10" may mean from 9 to 11.

What is claimed is:

1. An apparatus for supporting a medical device having one or more wires or tubes connecting the medical device to a patient, the apparatus comprising:

a garment panel having an internal side;

a pocket on the garment panel, the pocket having an interior configured to contain a medical device and an access opening for insertion of a medical device;

an aperture separate from the pocket access opening, the aperture communicating the pocket interior with the internal side of the garment panel for passage of one or more wires or tubes from the pocket interior to the internal side of the garment panel; and means for releasably separating wires or tubes within the aperture, whereby the apparatus avoids tangling of wires or tubes reaching through the aperture.

2. The apparatus of claim 1, wherein the means for releasably separating wires or tubes within the aperture comprises buttons.

3. The apparatus of claim 1, wherein the means for releasably separating wires or tubes within the aperture comprises hook and loop fasteners.

4. The apparatus of claim 1, further comprising medical device management hardware configured to secure a medical device within the pocket interior.

5. The apparatus of claim 1, wherein the aperture is one of a plurality of apertures that are open to the internal side of the garment panel and configured for passage of one or more wires or tubes to the internal side of the garment panel, and further comprising:

a pocket cover that is releasably attachable to the garment panel over any selected one of the apertures to define a pocket interior for containing a medical device beside any selected one of the apertures; and a fastener structure that releasably attaches the pocket cover over any selected one of the apertures.

6. An apparatus for supporting a medical device having one or more wires or tubes connecting the medical device to a patient, the apparatus comprising:

a garment panel having an internal side, an external side, and a plurality of apertures configured for passage of one or more wires or tubes from the external side to the internal side;

a pocket cover that is releasably attachable to the external side of the garment panel over any selected one of the apertures to define a pocket interior for containing a medical device beside any selected one of the apertures; and a fastener structure that releasably attaches the pocket cover over any selected one of the apertures.

7. The apparatus of claim 6, wherein the pocket cover provides an access opening for insertion of a medical device into a pocket interior defined by the pocket cover.

8. The apparatus of claim 6, further comprising medical device management hardware configured to secure a medical device within a pocket interior defined by the pocket cover.

* * * * *